US006913074B2

(12) United States Patent
Yamamoto et al.

(10) Patent No.: US 6,913,074 B2
(45) Date of Patent: Jul. 5, 2005

(54) METHOD OF MAKING AN INTERNAL GROOVED TUBE

(75) Inventors: Koji Yamamoto, Tokyo (JP); Tetsuya Sumitomo, Tokyo (JP); Yasutoshi Mori, Tokyo (JP); Toshiaki Hashizume, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 63 days.

(21) Appl. No.: 10/634,175

(22) Filed: Aug. 4, 2003

(65) Prior Publication Data

US 2004/0049917 A1 Mar. 18, 2004

Related U.S. Application Data

(62) Division of application No. 09/792,902, filed on Feb. 26, 2001, now abandoned.

(30) Foreign Application Priority Data

Feb. 25, 2000 (JP) ..... 2000-050090

(51) Int. Cl.[7] ..... B21C 1/24; F28F 1/14

(52) U.S. Cl. ..... 165/184; 165/133; 29/890.043; 72/77; 72/283

(58) Field of Search ..... 165/184, 133, 165/109.1; 29/890.043, 890.354, 890.045, 890.05; 72/75, 77, 122, 282, 283; 138/38, 42

(56) References Cited

U.S. PATENT DOCUMENTS

| | | | | |
|---|---|---|---|---|
| 4,373,366 A | * | 2/1983 | Tatsumi | 72/75 |
| 4,545,428 A | * | 10/1985 | Onishi et al. | 165/110 |
| 5,259,448 A | | 11/1993 | Masukawa et al. | |
| 5,332,034 A | | 7/1994 | Chiang et al. | |
| 5,555,622 A | | 9/1996 | Yamamoto et al. | |
| 5,862,857 A | | 1/1999 | Ishikawa et al. | |
| 6,164,370 A | | 12/2000 | Robinson et al. | |
| 6,202,703 B1 | | 3/2001 | Kuroda et al. | |

FOREIGN PATENT DOCUMENTS

| | | | | |
|---|---|---|---|---|
| JP | 54-37059 | | 3/1979 | |
| JP | 55-103215 | | 8/1980 | |
| JP | 8-21696 | | 1/1996 | |
| JP | 10258307 A | * | 9/1998 | B21C/1/22 |
| JP | 10296369 A | * | 11/1998 | B21H/3/00 |

* cited by examiner

*Primary Examiner*—Tho V Duong
(74) *Attorney, Agent, or Firm*—Knobbe Martens Olson & Bear LLP

(57) ABSTRACT

A method of manufacturing an internal grooved tube according to the present invention includes the steps of inserting a grooved plug into a blank tube rotatably, and then pressing the blank tube against the outside surface of the grooved tube with several balls revolving both around the circumference of the blank tube and on its axis in location of the grooved plug inserted, while drawing out the blank tube longitudinally in one direction, wherein the number of balls is limited to 2 to 3. A lead angle θ of the grooves to the tube axis is preferably limited to 26 to 45 degrees.

4 Claims, 5 Drawing Sheets

METHOD OF MAKING AN INTERNAL GROOVED TUBE

RELATED APPLICATIONS

This application is a divisional of application Ser. No. 09/792,902, filed Feb. 26, 2001 now abandoned, the disclosure of which is incorporated in its entirety herein by reference.

BACKGROUND OF THE INVENTION

1. Field of the Invention

This invention relates to an internal grooved tube used as a heat exchanger tube for a heat exchanger of a refrigerator and an air conditioner or the like and a method of manufacturing such an internal grooved tube, and more specifically, to an internal grooved tube having a large number of fine spiral grooves (or fins) formed on the inside surface in parallel arrangement at a certain pitch and a method of manufacturing such an internal grooved tube.

2. Description of the Related Art

The promotion of miniaturization, higher performance and energy conservation has been made as to a heat exchanger. In this connection, as an internal grooved tube to meet such demands, in Japanese Patent Laid-open No. 8-21696, for instance, there is proposed a heat exchanger tube having spiral grooves of a great height on the inside surface and fins of a sharp vertical angle.

As a method of manufacturing an internal grooved tube, in Japanese Patent Laid-open No. 54-37059, there is disclosed a method of manufacturing a heat exchanger tube by the steps of inserting a grooved plug having a large number of fine spiral grooves on the outside surface into a blank tube rotatably, then pressing the blank tube against the outside surface of the grooved plug with a plurality of rolls arranged to revolve both around the circumference of the blank tube and on its axis in a location of the grooved plug inserted, while drawing out the blank tube in one direction, and then using a holder to hold the roll axis for stabilizing the rotation of the rolls.

As a method for high-speed machining of an internal grooved tube, in Japanese Patent Laid-open No. 55-103215, there is disclosed a method of manufacturing a heat exchanger tube by the steps of inserting the grooved plug as described the above into a blank tube rotatably, and then pressing the blank tube against the outside surface of the grooved plug with balls densely arranged to revolve both around the circumference of the blank tube and on its axis in a location of the grooved plug inserted, while drawing out the blank tube in one direction.

The internal grooved tube disclosed in Japanese Patent Laid-open No. 8-21696 meets the requirements of spiral grooves of a great height and fins of a sharp vertical angle, permitting the achievement of the intended objects. However, with greater groove height (fin height), it is necessary to increase a thickness of a tube in proportion to the groove height, resulting in an increase in tube weight. Besides, large crushes of fins formed in the tube occur in tube expansion (by press-fitting a rod provided with a net ball at the tip for tube expansion to fix the tube to aluminum fins) for incorporating the tube into the heat exchanger, and as a result, the grooves formed to be of a great height could not often take satisfactory effect.

Among the internal grooved tube manufacturing methods, the method of permitting the planetary revolution of a plurality of rolls having axes held by the holder around the circumference of the blank tube in a location of the grooved plug inserted as disclosed in Japanese Patent Laid-open No. 54-37059 described the above requires a lubricating mechanism between the roll and the roll axis, in addition to the holder, for revolution of the rolls at high speed to increase a machining speed, resulting in an increase in roll diameter and also a complication of structure. For that reasons, an increase in number of revolutions of the rolls hinders the stability of the revolution of the roll and its rotation axis, and therefore, it is not possible to hold a stable orbit of revolution, resulting in a difficulty in increasing a grooving (rolling) speed.

In order to solve the above problems, the technique of arranging the balls densely, instead of the rolls, around the grooved plug location of the blank tube to be drawn out is developed, as disclosed in Japanese Patent Laid-open No. 55-103215 described the above. When the balls are in use in this manner, the balls and the blank tube make point-contact each other, permitting stable and higher-speed machining. Then, with an increase in number of balls, the balls might normally revolve around the circumference of the blank tube in a shorter period in the state of being pressed against the circumference of the blank tube to form the grooves on the inside surface of the tube by rolling, permitting more improved grooving workability, together with higher machining speed.

However, when the grooves of the grooved plug have a large lead angle to the axis, breakage (tear-off) of the blank tube occurs in process of machining to hinder higher-speed machining in spite of adding more balls. Thus, there has been a limit to manufacture of a high-performance heat exchanger tube having a large lead angle to the tube axis.

SUMMARY OF THE INVENTION

After having made various trials and errors, the present inventors found out the fact that the heat transfer performance of an internal grooved tube is at its highest when a width of each internal groove in the tube axial direction (the longitudinal direction) in the heat exchanger tube has a fixed relation to a groove height, resulting in the proposal of the present invention. It is an object of the present invention to provide an internal grooved tube, which permits the realization of higher performance, lightweight and miniaturization, without the need for greater internal groove height (greater fin height).

Another object of the present invention is to provide an internal grooved tube manufacturing method, which makes it possible to machine a heat exchanger tube satisfying the above object smoothly at high speed without causing breakage.

To attain the above objects, according to the present invention, there is provided an internal grooved tube, which comprises a large number of fine spiral grooves formed on the inside surface in parallel arrangement, wherein the ratio of a groove width W of each groove in the tube axial direction to a groove height H is in the range of 1 to 2. A lead angle θ of the above grooves to the tube axis is preferably limited to 26 to 35 degrees.

To attain the above objects, according to the present invention, there is provided an internal grooved tube manufacturing method, which comprises the steps of inserting a grooved plug having a large number of fine spiral grooves on the outside surface into a blank tube rotatably, and pressing the peripheral wall of the blank tube against the outside surface of the grooved plug with several balls revolving both around the circumference of the blank tube and on its axis in a location of the grooved plug inserted, while drawing out the blank tube longitudinally in one direction, wherein the number of balls is limited to 2 to 3.

A lead angle θ' of the grooves of the grooved plug to the axis is preferably limited to 26 to 45 degrees, and the direction of revolution of the balls is preferably allowed to match the direction of rotation of the grooved plug.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENT

Embodiment of Internal Grooved Tube

Figure 1:
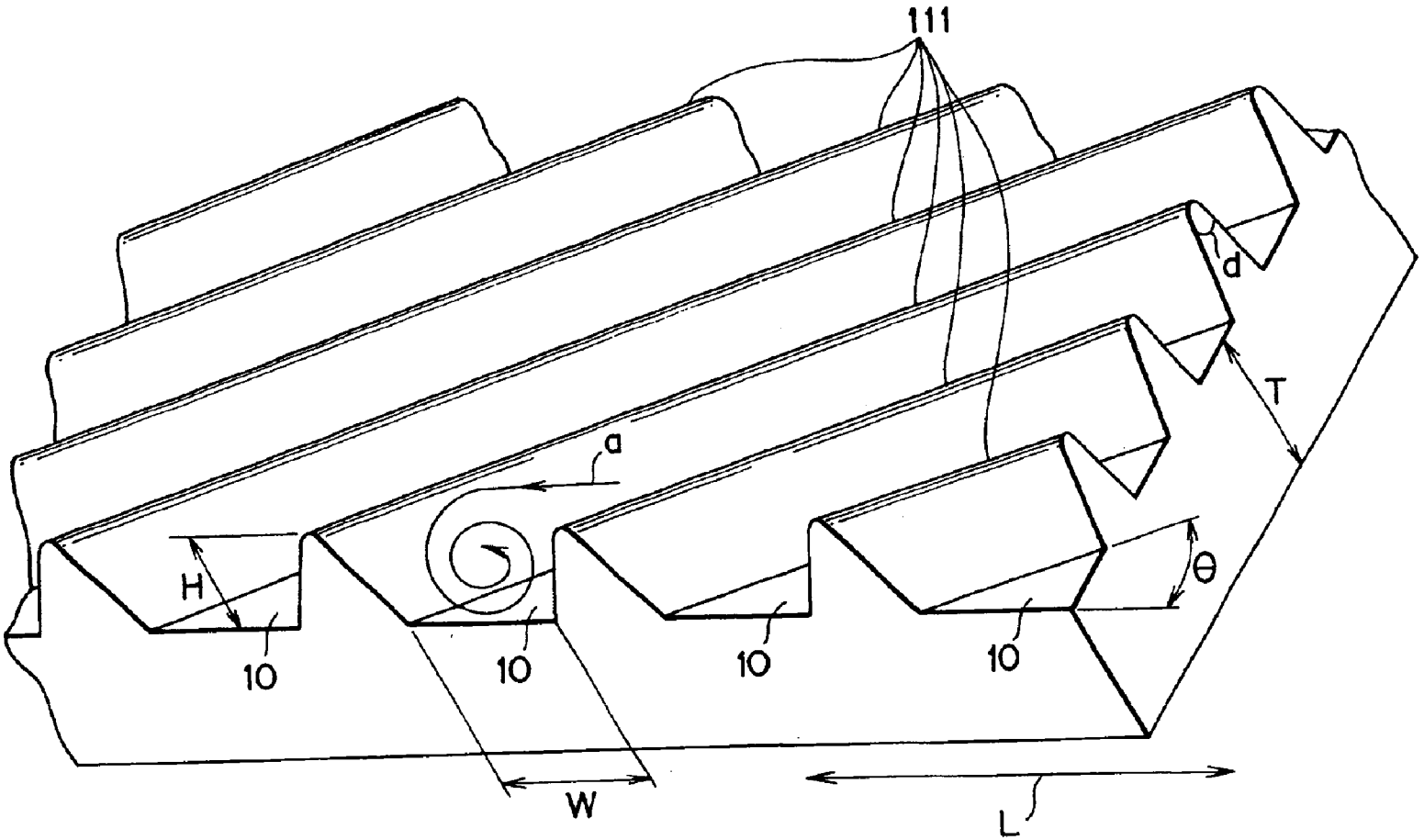
FIG. 1 is a partially enlarged development showing an embodiment of an internal grooved tube according to the present invention.

A heat exchanger tube 1 made of copper, copper alloy or other highly heat-conductive metal materials has a large number of fine spiral grooves 10 on the inside surface in parallel arrangement.

Each groove 10 is formed to assure that the ratio of a groove width W in the tube axial direction L to a groove height H may be in the range of 1 to 2, and that a lead angle θ of the grooves to the tube axis may be limited to 26 to 35 degrees.

The heat exchanger tube 1 having an outer diameter of about 7 mm is preferably 0.2 to 0.3 mm in bottom thickness T, 0.2 to 0.3 mm in groove height H, and 10 to 30 degrees in a vertical angle α of each fin 11 between the adjacent grooves 10.

Firstly, since the groove width W of each internal groove 10 in the tube axial direction L is equal to or twice as much as the groove height H, the internal grooved tube in the embodiment permits the sufficient growth of swirls occurring as shown by an arrow a in FIG. 1 when a flow of refrigerant (a flow in the tube axial direction) collides with the fins 11, resulting in the improvement of heat transfer performance.

That is, the optimum condition for the sufficient growth of swirls occurring in collision between the refrigerant and the fins 11 to fill the grooves with the swirls of refrigerant is that the groove width W of each internal groove 10 in the tube axial direction L should be equal to or twice as much as the groove height H.

Secondly, since the improvement of heat transfer performance is attained on the basis of the swirl effects of the refrigerant in the grooves, there is no need for excessive groove height (fin height) H, resulting in a reduction in heat exchanger tube weight. Besides, a tube expansion step required for incorporation of the tube into a heat exchanger permits less crushes of fins.

Thirdly, since the lead angle θ of the grooves 10 to the tube axis is limited to 26 to 35 degrees, the heat exchanger tube in the embodiment permits a relatively large collision between the refrigerant and the fins 11 without hindering the flow of refrigerant in the tube axial direction to excess, and the growth of refrigerant swirls in the grooves may be further hastened, resulting in the further improvement of heat transfer performance.

The most appropriate space (a space close to the apex of fins) for the growth of refrigerant swirls may be attained when the vertical angle α of each fin 11 between the adjacent grooves 10 is limited to 10 to 30 degrees, resulting in the further improvement of heat transfer performance.

When the ratio of the groove width W in the tube axial direction L to the groove height H is less than 1, the groove width W in the tube axial direction L is considered to be so small that the refrigerant swirls in the grooves 10 might not be grown enough to reach the groove bottom, resulting in the degradation of heat transfer performance.

On the other hand, when the ratio of the groove width W in the tube axial direction L to the groove height H exceeds twice, the groove width W is considered to be much greater than the size of the refrigerant swirls grown in the grooves 10 to permit formation of a portion making no contact with the refrigerant in the grooves 10, resulting in the hindrance of heat transfer acceleration.

Embodiment of Manufacturing Method

Figure 2:
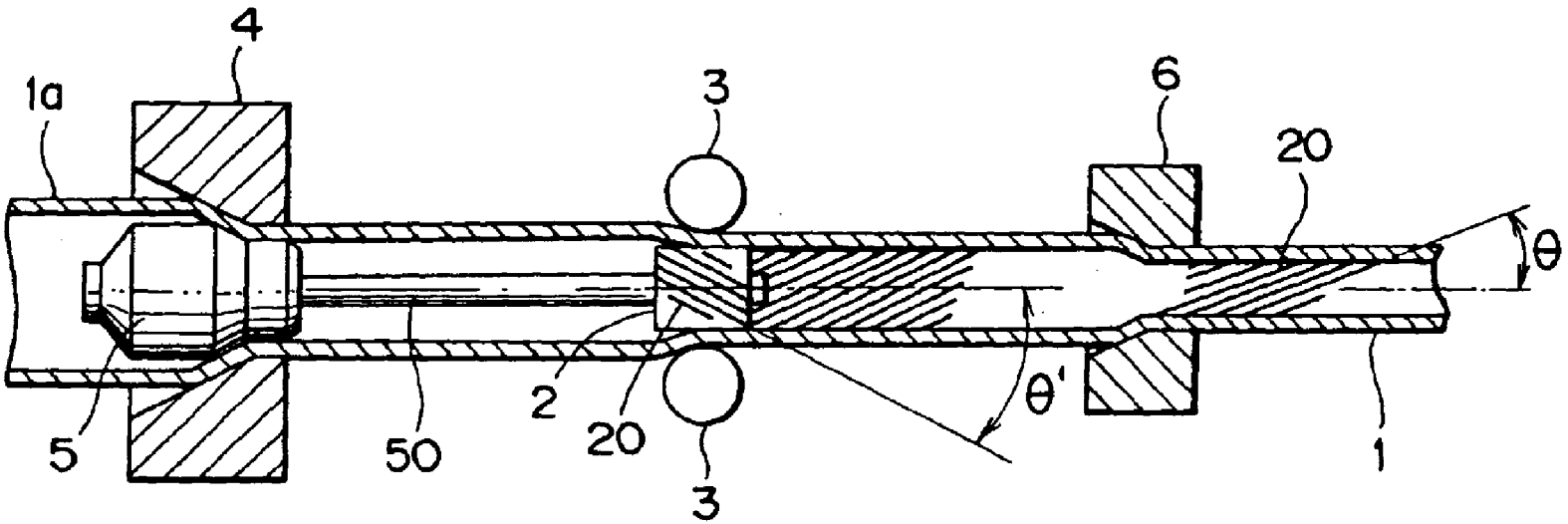
FIG. 2 is a schematic sectional view showing an apparatus for illustrating an embodiment of a method of manufacturing an internal grooved tube according to the present invention.

In FIG. 2, reference numeral 4 denotes a drawing die, and 5 is a floating plug. A small-diameter grooved plug 2 is connected rotatably to the tip of the floating plug 5 through a tie rod 50. A large number of fine grooves 20 having a lead angle θ' of 26 to 45 degrees to the axis are formed on the outside surface of the grooved plug 2 in parallel arrangement.

Two or three balls 3 capable of revolution and rotation in the state of being pressed against the grooved plug 2 are installed at uniform angular intervals in a location where the grooved plug 2 is installed.

A finishing die 6 is installed in a location on the further downstream side of the grooved plug 2.

After setting the tip part of a blank tube 1*a* made of copper alloy having an outer diameter of 12.5 mm, for instance, in the drawing die 4, the floating plug 5 is set in the blank tube 1*a* as shown in FIG. 2 to supply lubricating oil of relatively high viscosity to an upstream portion of the floating plug 5 in the blank tube 1*a*. Subsequently, while continuously supplying lubricating oil of low viscosity to a contact portion between the blank tube 1*a* and the balls 3 after drawing out the blank tube 1*a* in the right direction in FIG. 2, each ball 3 is operated to revolve around the blank tube 1*a* at a speed of about 10000/rpm in the state of being pressed against the outside surface of the blank tube 1*a*. The direction of revolution of the balls 3 is allowed to match the direction of rotation of the grooved plug 2.

The blank tube 1*a* is firstly subjected to reduction by drawing with the drawing die 4 and the floating plug 5, and the grooves 20 of the grooved plug 2 are transferred to the inside surface of the blank tube 1*a* while the blank tube 1*a* is further subjected to reduction by rolling with the grooved plug 2 and the balls 3. Thereafter, the blank tube is finished after being subjected to further reduction down to about 7 mm in outer diameter by sinking with the finishing die 6.

In the method of manufacturing the internal grooved tube according to the embodiment, when the lead angle θ' of the grooves 20 on the outside surface of the grooved plug 2 to the axis is limited to 45 degrees, the lead angle θ of the grooves 10 in the heat exchanger tube 1 to the tube axis comes to about 35 degrees in the reverse direction of the lead angle θ' of the grooves 20.

In the manufacturing method, there is no need to insert the finishing die 6 into the tube after forming the grooves 10 in some cases. In this case, the lead angle θ of the grooves 10 in the tube axial direction and the lead angle θ' of the grooves 20 of the grooved plug 2 are of the same value, while being reversed.

According to the manufacturing method of the embodiment, since the number of balls 3 is limited to 2 to 3, it is possible to manufacture the internal grooved tube having the structure as described in the above embodiment smoothly at high speed without causing breakage.

The internal grooved tube may be manufactured more smoothly at higher speed by allowing the direction of revolution of the balls 3 to match the direction of rotation of the grooved plug 2.

Figure 3:
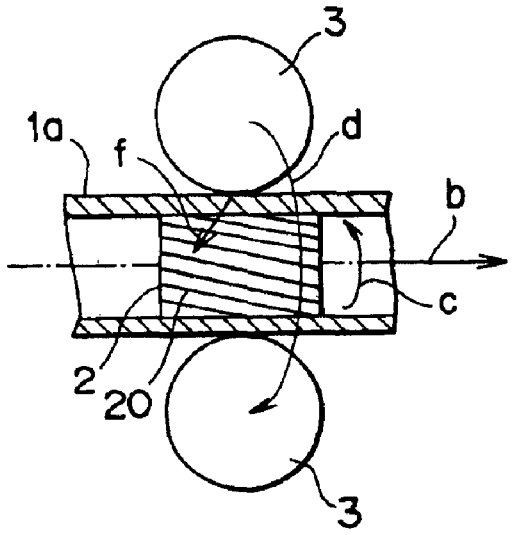
FIG. 3 is a partially sectional view showing the direction of metal flow in a blank tube when the direction of revolution of balls and the direction of rotation of a grooved plug are reversed in the method of manufacturing an internal grooved tube according to the present invention.
Figure 4:
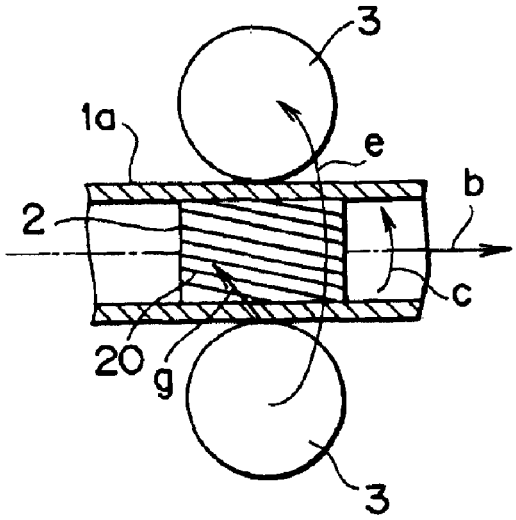
FIG. 4 is a partially sectional view showing the direction of metal flow in a blank tube when the direction of revolution of balls and the direction of rotation of a grooved plug are matched in the method of manufacturing an internal grooved tube according to the present invention.

A description will now be given of the reasons. As shown in FIGS. 3 and 4, for instance, assuming that the blank tube 1*a* is drawn out in the direction indicated by an arrow b and the twist direction of the grooves 20 of the grooved plug 2 is as shown in the drawings, the grooved plug 2 makes rotation in the direction as indicated by an arrow c through the movement of the blank tube 1*a* in the drawing direction b, together with the operation of the balls 3. In this place, when the direction of revolution of the balls 3 as shown by an arrow d in FIG. 3 and the direction c of rotation of the grooved plug 2 are reversed, the metal flow in the blank tube 1*a* occurs as shown by an arrow f through the movement of the blank tube 1*a*, together with the operation of the balls 3. In this case, since the metal flow direction f crosses the grooves 20 of the grooved plug 2 at a large angle, metal hardly flows into the grooves 20. That is, a high flow resistance to the metal flow is offered. On the other hand, when the direction of revolution of the balls 3 as shown by an arrow e in FIG. 4 and the direction c of rotation of the grooved plug 2 are matched, the metal flow in the blank tube 1*a* occurs as shown by an arrow g. In this case, since the metal flow direction g crosses the grooves 20 of the grooved plug 2 at a small angle, the metal smoothly flows into the grooves 20. That is, the flow resistance to the metal flow is reduced.

EXAMPLE 1

As shown in Table 1, with variations in a lead angle θ of the grooves 10 in the tube to the tube axis, heat exchanger tubes of sample Nos. 1 to 7 as the examples, in which the ratio of the groove width W in the tube axial direction L to the groove height H is in the range of 1 to 2, were manufactured, together with heat exchanger tubes of sample Nos. 8 to 19 as comparative examples, in which the ratio of the groove width W to the groove height H is in the range of less than 1 to more than 2. Then, the condensation performance of the above heat exchanger tubes was measured.

Table 1 shows the condensation performance rate when the condensation performance (reference) of the heat exchanger tube of sample No. 8 as the comparative example is assumed to be 1. In each heat exchanger tube other than those of sample Nos. 17 and 18, a copper tube having an outer diameter of 12 mm was used as a blank tube, which was then subjected to finishing into a tube having an outer diameter of 7 mm.

Rolling required for the above example may not apply to manufacture of the heat exchanger tubes of sample Nos. 17 and 18 as the comparative examples, in which the lead angle θ of the internal grooves to the tube axis exceeds 45 degrees. Thus, the above heat exchanger tubes were manufactured by the steps of forming the grooves on one surface of a metal strip by rolling with a grooved roll and a leveling roll, then molding the resultant metal strip in the shape of a tube using a group of molding rolls such that the grooved surface faces the inside, and then welding a butted part of the metal strip for construction of a tube, which was then subjected to finishing into a tube having an outer diameter of 7 mm.

As shown in Table 1, the heat exchanger tube in each example achieves condensation performance higher by 27% or above than the heat exchanger tubes of sample Nos. 15, 19 showing the condensation performance attained to the highest level among the heat exchanger tubes as the comparative examples. In particular, the heat exchanger tubes (of sample Nos. 1, 3, 4, 6 and 7), in which the lead angle θ of the internal grooves to the tube axis is more than 26 degrees, among the heat exchanger tubes as the examples achieve the higher condensation performance.

TABLE 1

| | Sample No. | Groove width W in tube axial direction | Groove height H | Groove twist angle θ | W/H | Condensation performance rate |
|---|---|---|---|---|---|---|
| Example of the invention | 1 | 0.26 | 0.26 | 35 | 1.00 | 2.00 |
| | 2 | 0.37 | 0.22 | 23 | 1.70 | 1.65 |
| | 3 | 0.28 | 0.20 | 35 | 1.40 | 1.90 |
| | 4 | 0.46 | 0.23 | 30 | 2.00 | 1.95 |
| | 5 | 0.36 | 0.24 | 23 | 1.50 | 1.70 |
| | 6 | 0.48 | 0.25 | 26 | 1.90 | 1.95 |
| | 7 | 0.46 | 0.23 | 31 | 2.00 | 1.80 |
| Comparative example | 8 | 1.05 | 0.21 | 18 | 5.00 | 1.00 |
| | 9 | 0.88 | 0.20 | 15 | 4.40 | 1.10 |
| | 10 | 0.55 | 0.24 | 20 | 2.30 | 1.15 |
| | 11 | 0.68 | 0.20 | 25 | 3.40 | 1.10 |
| | 12 | 0.67 | 0.21 | 30 | 3.20 | 0.90 |
| | 13 | 0.44 | 0.20 | 28 | 2.20 | 1.25 |
| | 14 | 0.33 | 0.15 | 40 | 2.20 | 1.10 |
| | 15 | 0.56 | 0.20 | 28 | 2.80 | 1.30 |
| | 16 | 1.35 | 0.27 | 15 | 5.00 | 1.20 |
| | 17 | 0.24 | 0.27 | 55 | 0.88 | 1.00 |
| | 18 | 0.17 | 0.22 | 61 | 0.79 | 0.80 |
| | 19 | 0.26 | 0.30 | 45 | 0.85 | 1.30 |

EXAMPLE 2

A blank tube consisting of a copper tube having an outer diameter of 12 mm was used to manufacture two kinds of heat exchanger tubes, which are 0.23 mm in groove height H, 0.46 mm in groove width W in the tube axial direction and respectively 20 and 31 degrees in lead angle θ of the grooves to the tube axis, according to the same conditions except that the number of machining balls varies from 2 to 6 without the need for a finishing die. Then, a change of drawing force was measured as to both the above heat exchanger tubes.

Figure 5:
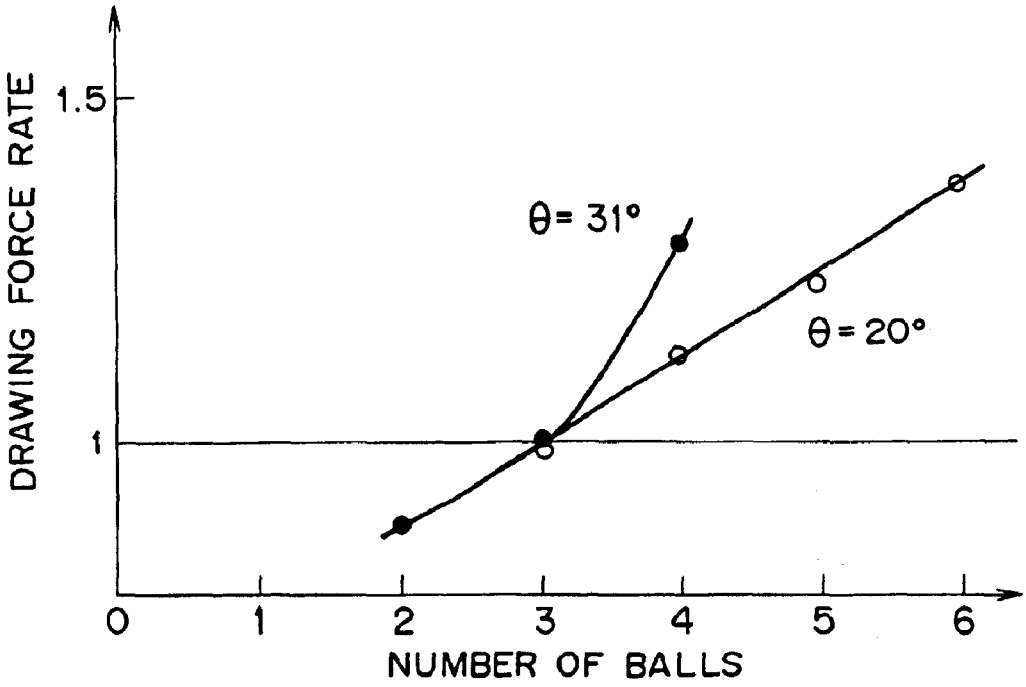
FIG. 5 is a graph showing the relation of the number of balls for grooving to a drawing force in a manufacture step of the internal grooved tube, when the internal grooves have a small lead angle to the tube axial direction and when those have a large lead angle.

The results are shown in FIG. 5, in which the horizontal line is denoted as the number of balls and the vertical line as a drawing force rate. As shown in FIG. 5, in case of the heat exchanger tube having a relatively small lead angle θ (20 degrees) of the internal grooves, the drawing force increased at a substantially fixed rate with an increase in number of balls. On the other hand, in case of the heat exchanger tube having a large lead angle θ (31 degrees) of the grooves, the use of four or more balls results in an increase in drawing force more rapidly than that when two or three balls were in use.

EXAMPLE 3

A blank tube consisting of a copper tube having an outer diameter of 12 mm was used to manufacture a heat exchanger tube of sample No. 7 (a lead angle θ of the grooves before finish drawing is 36 degrees, while a lead angle θ of the grooves after finish drawing is 31 degrees) as the example, together with a heat exchanger tube of sample No. 16 (a lead angle θ of the grooves before finish drawing is 20 degrees, while a lead angle θ of the grooves after finish drawing is 15 degrees) as the comparative example according to the same conditions except that the number of machining balls varies from 2 to 6. Then, a critical (maximum) grooving speed (drawing speed) was measured as to both the heat exchanger tubes.

Incidentally, the heat exchanger tube of sample No. 7 as the example was manufactured on condition that the direction of revolution of the balls and the direction of rotation of the grooved plug are matched and also on condition that both the directions are reversed. On the other hand, the heat exchanger tube of sample No. 16 as the comparative example was manufactured on condition that the direction of revolution of the balls and the direction of rotation of the grooved plug are reversed.

Figure 6:
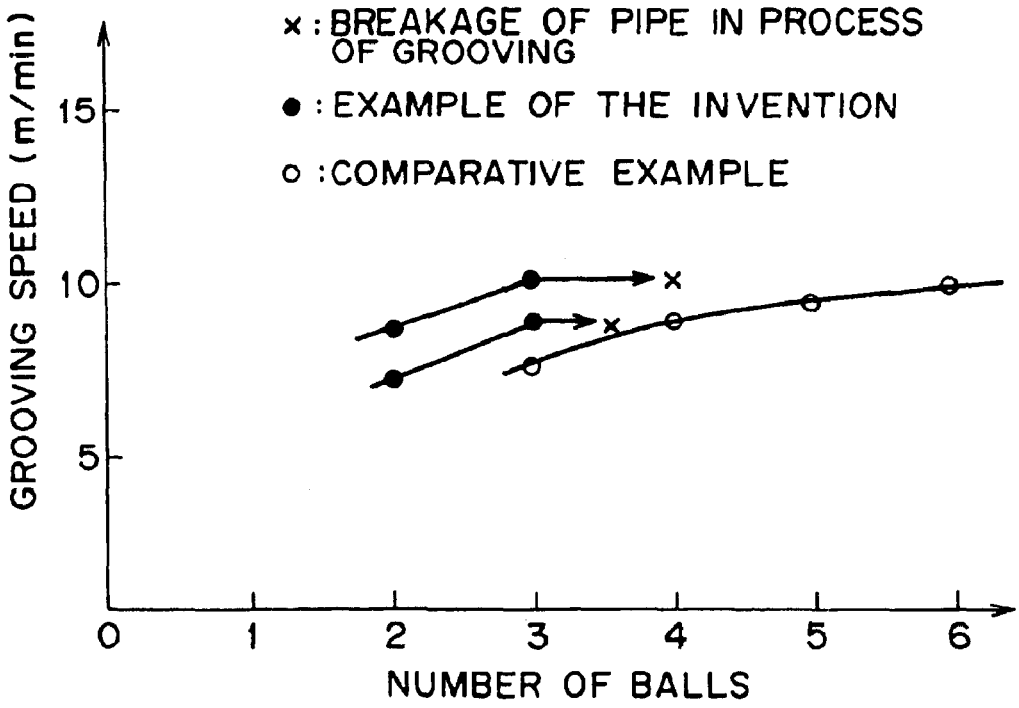
FIG. 6 is a graph showing the relation of the number of balls to a grooving speed (a drawing speed), when heat exchanger tubes according to an example of the present invention and those according to a comparative example were manufactured.

The results are shown in FIG. 6. In FIG. 6, in manufacture of the heat exchanger tube of sample No. 16 as the comparative example having a relatively small lead angle θ of the grooves, a critical grooving speed gradually increased at a substantially fixed rate with an increase in number of balls. On the other hand, when the heat exchanger tube of sample No. 7 as the example was manufactured by the use of four balls at the same grooving speed as the case of using three balls, the breakage of a tube occurred in process of machining.

Further, when the direction of revolution of the balls was allowed to match the direction of rotation of the grooved plug, the critical machining speed was improved more than that when both the directions were reversed.

EXAMPLE 4

A copper tube having an outer diameter of 12 mm was used to manufacture a heat exchanger tube, which is 0.23 mm in groove height H, 0.46 mm in groove width W in the tube axial direction, 10 mm in outer diameter and 3000 m in length, by the use of grooved plugs having groove lead angles θ' varying from 10 to 50 degrees by only rolling without the need for finish sinking on condition that the number of machining rolls varies from 2 to 6.

Figure 7:
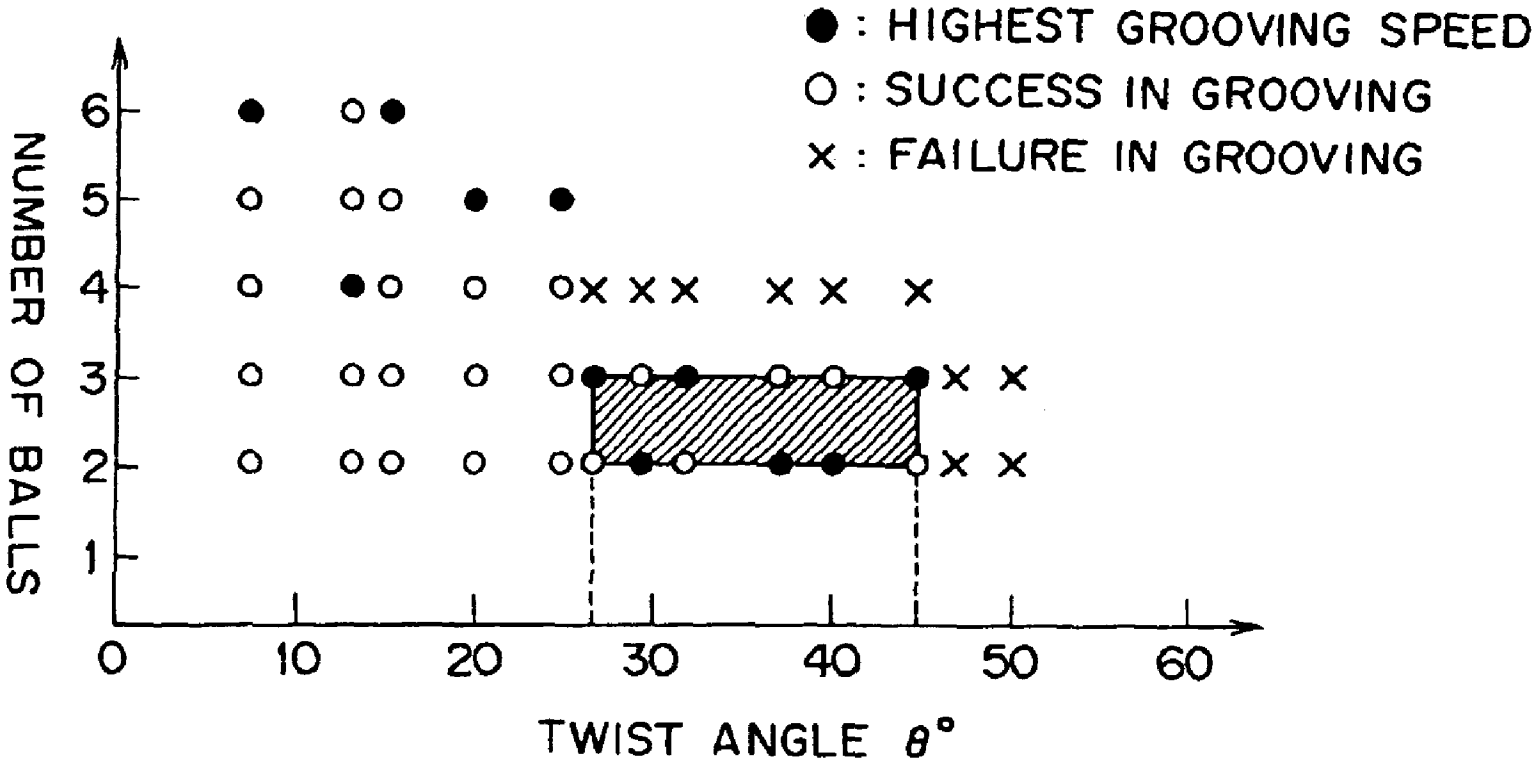
FIG. 7 is a graph showing the relation among a variation in lead angle of the grooves of a grooved plug to the axis, the number of balls and the results of grooving in the manufacture step of the internal grooved tube.

In FIG. 7, the number of balls in the critical machining speed is represented by ●, the number of balls in the machining speed lower than the critical machining speed is by ○, and a failure in grooving (a case where the breakage of the tube occurred in process of machining) is by x, respectively.

As a result, in case of the grooved plugs having the groove lead angle θ' of 10 to 25 degrees, the machining speed reached the maximum by the use of four to six balls. On the other hand, in case of the grooved plugs having the groove lead angle θ' of 26 to 45 degrees, the machining speed reached the maximum by the use of two to three balls, whereas the breakage of the tube occurred in process of machining when four or more balls were in use. Further, in case of the grooved plug having the groove lead angle θ' of more than 45 degrees, the breakage of the tube occurred in process of machining even by slowing down the machining speed, resulting in a failure of machining.

It is found from the results shown in FIGS. 5 to 7 that in manufacture of the internal grooved tube as described in the above example by rolling, the use of two to three machining balls less than those required for the prior art permits a mass production of internal grooved tubes smoothly with high workability without the need for an increase in drawing force to excess.

According to the internal grooved tube according to the present invention, since the groove width W of each internal groove 10 in the tube axial direction L is equal to or twice as much as the groove height H, this internal grooved tube permits the sufficient growth of swirls occurring as shown by the arrow a in FIG. 1 in collision between the refrigerant flow (the flow in the tube axial direction) and the fins 11, resulting in the improvement of heat transfer performance.

Further, since the improvement of heat transfer performance is attained on the basis of the swirl effects of the refrigerant in the grooves, there is no need for excessive groove height (fin height) H, resulting in a reduction in heat exchanger tube weight. Besides, tube expansion required for incorporating the heat exchanger tube into the heat exchanger permits less crushes of fins.

Further, when the lead angle θ of the grooves 10 in the tube to the tube axis is limited to 26 to 35 degrees, the heat exchanger tube of the present invention permits a relatively large collision between the refrigerant and the fins 11 without hindering the flow of the refrigerant in the tube axial direction to excess, and the growth of refrigerant swirls in the grooves may be further hastened, resulting in the further improvement of heat transfer performance.

According to the method of manufacturing the internal grooved tube according to the present invention, the number of balls 3 is limited to 2 to 3, resulting in smooth high-speed manufacture of the internal grooved tube according to the present invention without causing the breakage.

When the direction of revolution of the balls 3 is allowed to match the direction of rotation of the grooved plug 2, it is possible to manufacture the internal grooved tube according to the present invention more smoothly at higher speed.

What is claimed is:

1. A method of manufacturing an internal grooved tube comprising the steps of:

inserting a grooved plug having a large number of fine spiral grooves on the outside surface into a blank tube rotatably; and pressing the peripheral wall of the blank tube against the outside surface of the grooved plug with several balls revolving both around the circumference of the blank tube and on its axis in a location of the grooved plug inserted, while drawing out the blank tube longitudinally in one direction;

wherein the number of balls is limited to 2 to 3, and wherein a lead angle θ of said grooves of the grooved plug to the axis is limited to 26 to 45 degrees.

2. A method of manufacturing an internal grooved tube according to claim 1, wherein the direction of revolution of the balls is allowed to match the direction of rotation of the grooved plug.

3. The method of claim 1, wherein the ratio of a groove width W in the tube axial direction to a groove height H is in the range of 1 to 2.

4. The method of claim 1, wherein the lead angle θ is in the range of26 to 35 degrees.

* * * * *